US007032397B1

(12) United States Patent
Mueller et al.

(10) Patent No.: US 7,032,397 B1
(45) Date of Patent: Apr. 25, 2006

(54) THERMOSTAT FOR USE WITH COMPRESSOR HEALTH INDICATOR

(75) Inventors: Carl J. Mueller, St. Louis, MO (US); Nagaraj B. Jayanth, Sidney, OH (US)

(73) Assignee: Emerson Electric Co., St. Louis, MO (US)

( * ) Notice: Subject to any disclaimer, the term of this patent is extended or adjusted under 35 U.S.C. 154(b) by 14 days.

(21) Appl. No.: 10/750,113

(22) Filed: Dec. 31, 2003

Related U.S. Application Data

(60) Provisional application No. 60/501,689, filed on Sep. 9, 2003.

(51) Int. Cl.

| | |
|---|---|
| ***F25B 1/00*** | (2006.01) |
| ***F25B 49/00*** | (2006.01) |
| ***H02H 7/00*** | (2006.01) |
| ***F21V 7/04*** | (2006.01) |

(52) U.S. Cl. ..... 62/230; 62/126; 62/127; 236/94; 361/22; 361/31

(58) Field of Classification Search ..... 62/126, 62/127, 129, 230; 165/4.1; 236/94; 361/22, 361/23, 24, 30, 31
See application file for complete search history.

(56) References Cited

U.S. PATENT DOCUMENTS

| | | | | |
|---|---|---|---|---|
| 3,817,052 | A * | 6/1974 | Connelly et al. | 62/158 |
| 4,022,598 | A * | 5/1977 | Gucwa et al. | 62/164 |
| 4,307,775 | A * | 12/1981 | Saunders et al. | 165/11.1 |
| 5,467,245 | A * | 11/1995 | Newbould | 361/170 |
| 5,537,834 | A * | 7/1996 | Farr | 62/126 |
| 6,758,051 | B1 * | 7/2004 | Jayanth et al. | 62/126 |

* cited by examiner

*Primary Examiner*—Marc Norman
(74) *Attorney, Agent, or Firm*—Harness, Dickey & Pierce, P.L.C.

(57) ABSTRACT

A method of operating a climate control system includes generating a signal based upon the operation of the compressor, and controlling the compressor in response to the generated signal. A climate control system implementing the method includes a compressor, and module for generating at least one signal based upon the operation of the compressor, and a thermostat for controlling the compressor, the thermostat controlling the compressor in response to signals generated by the module. A system for controlling a compressor in a climate control system implementing the method includes a module that generates signals relating to the operation of the compressor, and a thermostat, responsive to the module, for controlling the compressor. A thermostat for controlling a climate control system having a compressor implementing the method operates the compressor in response to at least one signal representative of the operation of the compressor.

3 Claims, 7 Drawing Sheets

THERMOSTAT FOR USE WITH COMPRESSOR HEALTH INDICATOR

CROSS REFERENCE TO RELATED APPLICATION

This application claims priority of prior U.S. Provisional Patent Application Ser. No. 60/501,689, filed Sep. 9, 2003.

BACKGROUND OF THE INVENTION

This invention relates to thermostats, and in particular to thermostats used for controlling climate control systems that include a compressor, such as an air conditioning compressor and/or a heat pump compressor.

Thermostats are used to control climate control systems to maintain the space served by the climate control system at a selected set point temperature. The thermostat compares the sensed temperature in the space with the set point temperature, and if the set point temperature is not satisfied operates the climate control system to cause the climate control system to heat and/or cool the space to the set point temperature. Some heating systems include a compressor, for example, heat pump systems, and most cooling systems include a compressor. Conventional thermostats control these compressors by turning them on when there is a demand for heating or cooling. However, conventional thermostats cannot accommodate problems with the compressor. In fact, a problem with the compressor typically manifests itself to the thermostat as an inability of the climate control system to achieve the set temperature, and the thermostat typically exacerbates the problem by continuing the demand for heating or cooling to meet the set point temperature.

SUMMARY OF THE INVENTION

The present invention provides for locking out a compressor when the compressor experiences problems. In a preferred embodiment this is implemented by a thermostat which de-energizes the compressor in response to a compressor fault signal. In one preferred embodiment, in addition to de-energizing the compressor, the thermostat locks out the compressor from further operation. This lockout may be for a predetermined period, or until the fault signal ends, or until the system is reset. In another preferred embodiment, the thermostat may try to restart the compressor one or more times, after a predetermined lockout period. This thermostat preferably only attempts to restart the compressor a predetermined number of times, and if the fault signal is not resolved after this predetermined number of cycles, locks the compressor until the system is reset.

Generally a climate control system in accordance with the principles of this invention comprises a compressor, and module for generating at least one signal based upon the operation of the compressor, and a thermostat for controlling the compressor, the thermostat controlling the compressor in response to signals generated by the module.

Generally, a system for controlling the compressor in a climate control system in accordance with the principles of the present invention comprises a module that generates signals relating to the operation of the compressor, and a thermostat, responsive to the module, for controlling the compressor.

Generally, a thermostat for controlling a climate control system having a compressor in accordance with the principles of the present invention operates the compressor in response to at least one signal representative of the operation of the compressor. In response to the at least one signal, various embodiments of the thermostat may display an alarm, deenergize the compressor, deenergize and lock out the compressor, and/or deenergize and attempt to restart the compressor.

Thus the climate control system, the control for a climate control system, and the thermostat implementing the present invention provide can respond to compressor problems, in various embodiments providing an alarm, shutting off the compressor, and/or even restarting the compressor to resolve the compressor problem.

BRIEF DESCRIPTION OF THE DRAWINGS

Corresponding reference numerals indicate corresponding parts throughout the several views of the drawings.

DETAILED DESCRIPTION OF THE INVENTION

Figure 1:
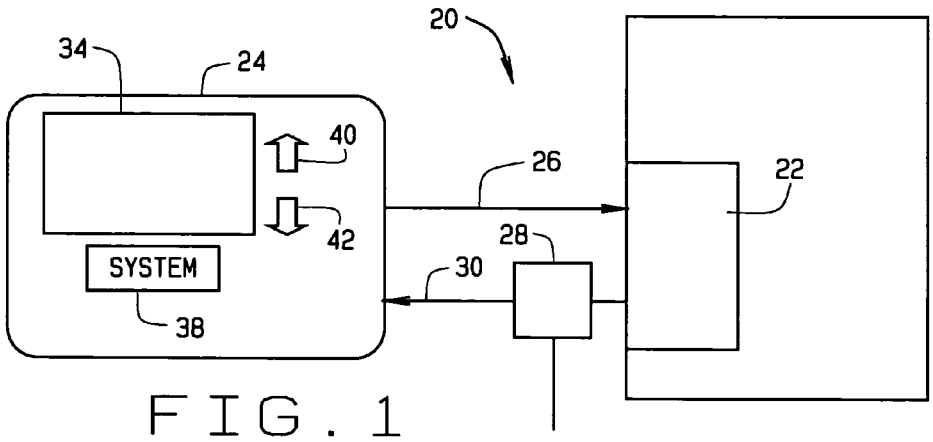
FIG. 1 is a schematic diagram of a portion of a climate control system, showing a compressor, a compressor indicator module, and a thermostat, in accordance with the principles of a first embodiment of this invention.
Figure 2:
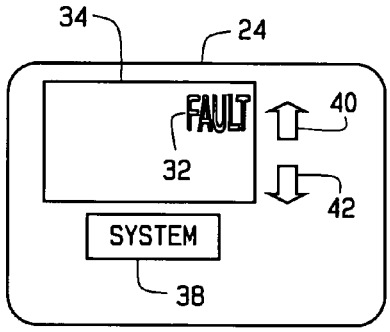
FIG. 2 is a front elevation view of a thermostat, showing one means of indicating a possible compressor problem.

A climate control system in which embodiments of the present invention can be implemented is indicated generally as 20 in FIG. 1. The climate control system includes at least one compressor 22, and may be a heating system, such as a heat pump, an air conditioning system, or a combined heating and air conditioning system. A thermostat 24 controls the operation of the climate control system 20, via link 26. The link 26 may comprise one or more wires between the thermostat 24 and the climate control system 20, or it could be a fiber optic, or an IR or RF communication link, or other wireless communication link.

A compressor health indicator module 28 is associated with the compressor for indicating the status of the compressor, and in particular indicating one or more fault conditions. The module 28 preferably generates at least one alert signal that is provided via link 30 to thermostat 24 controlling the climate control system. For example, the module 28 may monitor the current drawn by the compressor, and generate signals in response thereto. In addition, or alternatively, the module may monitor other aspects of the operation of the compressor, and generate signals in response thereto. The link 30 may comprise one or more wires between the module 28 and the thermostat 24, or it could be fiber optic, an IR or RF communication link, or other wireless communication link.

Signals from the module 28 to the thermostat 24 can cause the thermostat to operate the compressor 22. In response to an alert signal indicative of a fault or problem, the thermostat can respond in one or more ways, including (1) providing a warning to the user; (2) temporarily or permanently locking out the compressor; and/or (3) retrying the compressor one or more times.

For example, in response to a first alert signal from the module 28, the thermostat 24 can display a fault signal 32 on a display 34. This fault signal 32 may be an icon that flashes, for example synchronously with the signal received from the module 28. The fault signal 32 may also be a standard message such as "FAULT" or "NEEDS SERVICE" that flashes, for example, synchronously with the signal received from the module 28. The fault signal 32 may also be an error code or text message specific to the alert signal from the module.

Figure 3:
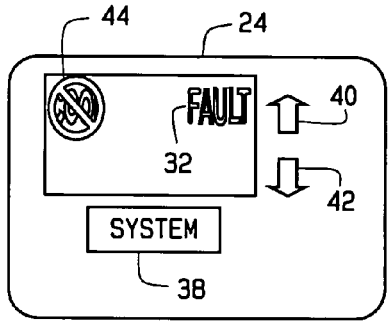
FIG. 3 is a front elevation view of a thermostat, showing an alternate means of indicating a possible compressor problem.
Figure 4:
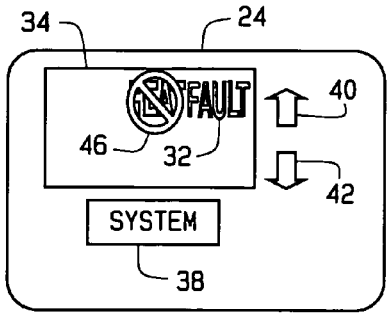
FIG. 4 is a front elevation view of a thermostat showing an alternate means of indicating a possible compressor problem.
Figure 5A:
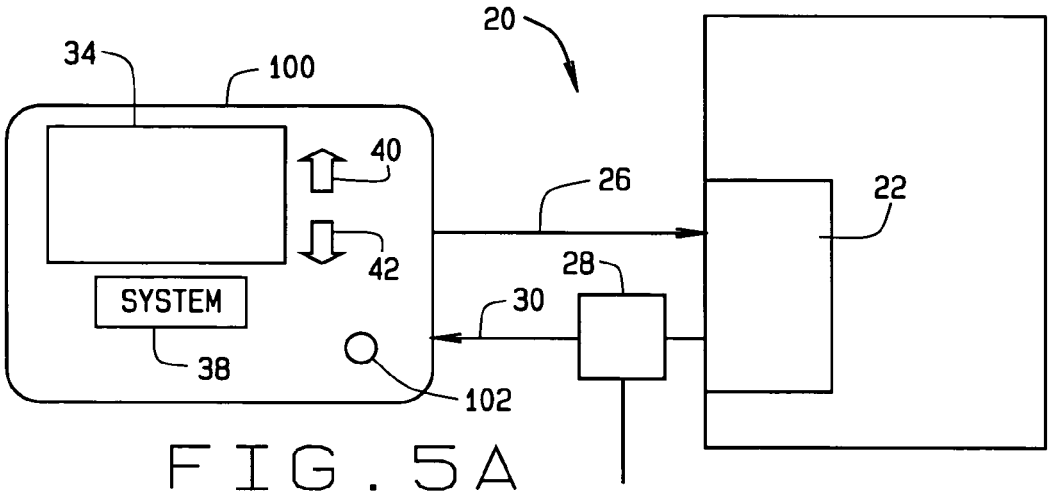
FIG. 5A is a schematic diagram of a first preferred embodiment of a thermostat, adapted for use with a commercially available compressor health indicator.
Figure 5B:
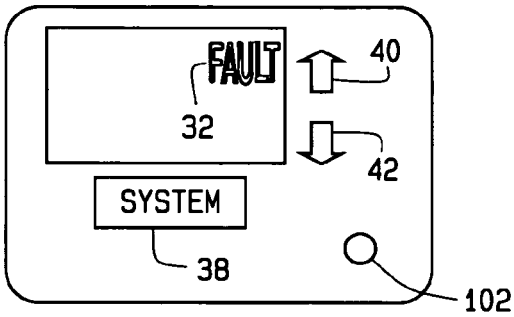
FIG. 5B is a schematic diagram of the thermostat in FIG. 5A, showing a possible fault warning.
Figure 5C:
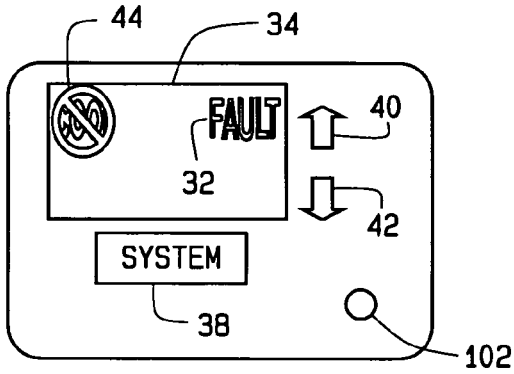
FIG. 5C is a schematic diagram of the thermostat in FIG. 5A, showing a possible fault warning and "no cool" warning.
Figure 5D:
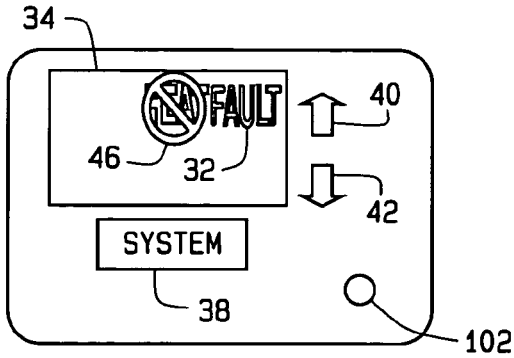
FIG. 5D is a schematic diagram of the thermostat in FIG. 5A, showing a possible fault warning and "no heat" warning.

The thermostat preferably also has a selectable lockout mode which locks out the compressor in response to a second alert signal. The lock out mode is selected, for example, by pressing the system button 38 on the thermostat 24, and operating the up and down arrow buttons 40 and 42 to toggle between an "on" mode, in which the compressor is locked out in response to an appropriate error signal, and an "off" mode in which the compressor is not locked out in response to an error signal. When the lock out mode is selected, in response to a second alert signal, the thermostat 24 may de-enerzize the compressor within a predetermined time. The thermostat 24 may require more than one alert signal to verify that there is a fault condition (e.g., two successive alert signals), so that the compressor is not unnecessarily de-energized. A cool fault signal 44 (FIG. 3) or a heat fault signal 46 (FIG. 4) may flash on the display 34 if the thermostat set point is not satisfied while the compressor is disabled.

If deenergizing the compressor does not clear the second signal, after a predetermined lockout time, the thermostat 24 may re-energize the compressor for a predetermined period, and repeat this reenergization after a predetermined lock-out period. After a predetermined number of reenergization attempts, the thermostat permanently locks out the compressor until the transmission of the second signal from the module 28 ceases, or until the thermostat is reset, for example by pressing a button on the thermostat 24. The cycling of the compressor can be implemented with a counter, that is preferably reset when the thermostat is reset.

If deenergizing the compressor clears the second alert signal, normal operation can resume after a predetermined lock out period. The thermostat counter is reset.

In response to a third alert signal, the thermostat 24 may de-energize the compressor within a predetermined period for at least a predetermined lockout period. A cool fault signal 44 (FIG. 3) or a heat fault signal 46 (FIG. 4) may flash on the display 34 if the thermostat set point is not satisfied, and the compressor is disabled. After the predetermined lockout period, the thermostat will re-energize the compressor the next time that the set point temperature is not satisfied. This will continue for a predetermined number of reenergization attempts. After a predetermined number of reenergization attempts, the thermostat permanently locks out the compressor until the transmission of the third alert signal from the module 28 ceases, or until the thermostat is reset, for example by pressing a button on the thermostat. The cycling of the compressor can be implemented with a counter, that is preferably reset when the thermostat is reset or when normal operation of the compressor resumes.

If deenergizing the compressor clears the third signal, normal operation can resume after a predetermined lock out period. The thermostat counter is reset.

In response to a fourth signal, the thermostat 24 may de-energize the compressor within a predetermined for a predetermined period. A cool fault signal 44 (FIG. 3) or a heat fault signal 46 (FIG. 4) may flash on the display 34 if the thermostat set point is not satisfied, and the compressor is disabled.

The thermostat will not reenergize the compressor until the fourth alert signal ceases, or unless reset by the user, for example by pressing a button on the thermostat. If reenergizing the compressor clears the fourth signal, normal operation can resume, preferably after a predetermined minimum lock out period.

EXAMPLE 1

The compressor health module 28 may be a Comfort Alert™ module available from Copeland Industries, Inc., part of Emerson Climate technologies. A thermostat in accordance with a first preferred embodiment of this invention is specifically adapted for use with the Comfort Alert™ module 28. This Comfort Alert™ module 28 is connected to the compressor in a climate control system (e.g., an air conditioning or heat pump system) and generates signals based upon the operation of the compressor. The operation of the Comfort Alert™ is illustrated in Table 1, which shows the various signals generated by the Comfort Alert™

TABLE 1

EXAMPLE CODES FROM A COPELAND COMFORT ALERT ™ COMPRESSOR HEALTH INDICATOR

| Status LED | Status LED Description | Status LED Troubleshooting Information |
|---|---|---|
| Green "POWER" | Module Has Power | Supply voltage is present at module terminals |
| Red "TRIP" | Thermostat demand signal Y1 is present, but the compressor is not running | 1. Compressor protector is open<br>Check for high head pressure<br>Check compressor supply voltage<br>2. Outdoor unit power disconnect is open<br>3. Compressor circuit breaker or fuse(s) is open<br>4. Broken wire or connector is not making contact<br>5. Low pressure switch open if present in system<br>6. Compressor contact has failed open |
| Yellow "ALERT" Flash Code 1 | Long Run Time<br>Compressor is running extremely long run cycles | 1. Low refrigerant charge<br>2. Evaporator blower is not running<br>Check blower relay coil and contacts<br>Check blower motor capacitor<br>Check blower motor for failure or blockage<br>Check evaporator blower wiring and connectors<br>Check indoor blower control board<br>Check thermostat wiring for open circuit<br>3. Evaporator coil is frozen<br>Check for low suction pressure<br>Check for excessively low thermostat setting<br>Check evaporator airflow (coil blockages or return air filter)<br>Check ductwork or registers for blockage<br>4. Faulty metering device<br>Check TXV bulb installation (size, location, contact)<br>5. Condenser coil is dirty<br>6. Liquid line restriction (Filter drier blocked if present in system)<br>7. Thermostat is malfunctioning<br>Check thermostat sub-base or wiring for short circuit<br>Check thermostat installation (location, level) |
| Yellow "ALERT" Flash Code 2 | System Pressure Trip<br>Discharge or suction pressure out of limits or compressor overloaded | 1. High head pressure<br>Check high pressure switch if present in system<br>Check if system is overcharged with refrigerant<br>Check for non-condensable in system<br>2. Condenser coil poor air circulation (dirty, blocked, damaged)<br>3. Condenser fan is not running<br>4. Return air duct has substantial leakage<br>5. If low pressure switch present in system, refer to Flash Code 1 |
| Yellow "ALERT" Flash Code 3 | Short Cycling<br>Compressor is running only briefly | 1. Thermostat demand signal is intermittent<br>2. Time delay relay or control board defective<br>3. If high pressure switch is present, refer to Flash Code 2<br>4. If low pressure switch present, refer to Flash Code 1 |
| Yellow "ALERT" Flash Code 4 | Locked Rotor | 1. Run capacitor has failed.<br>2. Low line voltage (contact utility if voltage at disconnect is low)<br>3. Excessive liquid refrigerant in compressor<br>4. Compressor bearings are seized<br>Measure compressor oil level |
| Yellow "ALERT" Flash Code | Open Circuit | 1. Outdoor unit power disconnect is open<br>2. Compressor circuit breaker or fuse(s) is open |

TABLE 1-continued

EXAMPLE CODES FROM A COPELAND COMFORT ALERT ™ COMPRESSOR HEALTH INDICATOR

| Status LED | Status LED Description | Status LED Troubleshooting Information |
|---|---|---|
| 5 | | 3. Compressor contactor has failed open<br>Check compressor contactor wiring and connectors<br>Check for compressor contactor failure (burned, pitted, or open)<br>Check wiring and connectors between supply and compressor<br>Check for low pilot voltage at compressor contactor coil<br>4. High pressure switch is open and requires manual reset.<br>5. Open circuit in compressor supply wiring or connections<br>6. Unusually long compressor protector reset time due to extreme ambient temperature<br>7. Compressor windings are damaged<br>Check compressor motor winding resistance |
| Yellow "ALERT" Flash Code 6 | Open Start Circuit<br>Current only in run circuit | 1. Run capacitor has failed.<br>2. Open circuit in compressor start wiring or connections<br>Check wiring and connectors between supply and the compressor "S" terminal<br>3. Compressor start winding is damaged<br>Check compressor motor winding resistance |
| Yellow "ALERT" Flash Code 7 | Open Run Circuit<br>Current only in start circuit | 1. Open circuit in compressor run wiring or connections<br>Check wiring and connectors between supply and the compressor "R" terminal<br>2. Compressor run winding is damaged |
| Yellow "ALERT" Flash Code 8 | Welded Contactor<br>Compressor always runs | 1. Compressor contactor has failed closed<br>2. Thermostat demand signal not connected to module. |
| Yellow "ALERT" Flash Code 9 | Low Voltage<br>Control Circuit <17 VAC | 1. Control circuit transformer is overloaded<br>2. Low line voltage (contact utility if voltage at disconnect is low)<br>Check wiring connections |

As shown in the Table 1, at least Yellow "ALERT" Flash Codes 2, 3, 4, 6, and 7 relate to faults that a thermostat can address. However, in response to all of the signals, and at least all of the Yellow ALERT flash codes, the thermostat 100 of FIG. 5 can display a fault signal of at least a flashing light and/or a flashing text message. Thermostat 100 in FIG. 5 is similar to thermostat 24, described above, and corresponding parts are identified with corresponding reference numerals. The fault signals preferably flash corresponding to the flashing signal from the Comfort Alert™ module 28. This allows the user or a service technician to determine the status of the compressor from the thermostat 100.

As shown in FIG. 5, the thermostat 100 has a diode 102 that blinks in synchronization with the signals generated by the Comfort Alert™ module 28. The thermostat 100 also has a display 34 for displaying a message. This message may be a predetermined message for all signals from the Comfort Alert™ module 28, such as "FAULT". The message can blink in synchronization with the signals generated by the Comfort Alert™ module 28. Thus by watching either the blinking diode or the blinking message on the thermostat, a service technician can determine the status of the compressor as indicated by the Comfort Alert™ module 28. As described in more detail below, the thermostat includes means, such as a microprocessor, for determining the blink rate, and thus identifying the particular signal being generated by the Comfort Alert™ module 28. In response, the thermostat can display an error code or text message specific to the signal generated by the Comfort Alert™ module 28. For example, the thermostat could display "2" or "Code 2" when the Comfort Alert™ module 28 is generating flash code 2, alternatively, the thermostat could display a text explanation of the error code, in the case of flash code 2, for example displaying "System Pressure Trip" or "Pressure Out of Limits" or similar informational message.

Figure 6A:
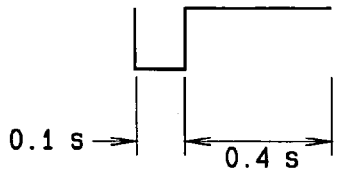
FIG. 6A is a diagram of the signal pulse from one type of commercially available compressor health indicator.
Figure 6B:
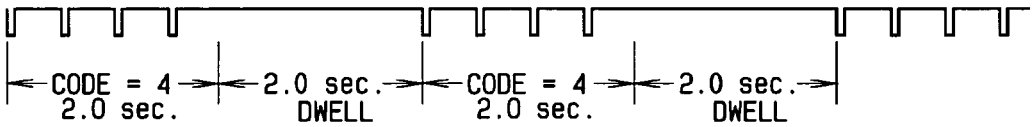
FIG. 6B is a diagram of a signal from one type of commercially available compressor health indicator.

Compressor health indicator alert signals typically comprise a series of one or more flashes or pulses followed by a dwell. In the case of the Comfort Alert™ module 28, and as shown in FIG. 6A each individual flash comprises a 0.1s "on" followed by a 0.4s "off", and the dwell is 2s. Thus, as shown in FIG. 6B to display a flash code of 4, the Comfort Alert™ would display four pulses each 0.1s long, and each followed by a 0.4s dwell, and the entire series separated from the next by a two second dwell.

Figure 7:
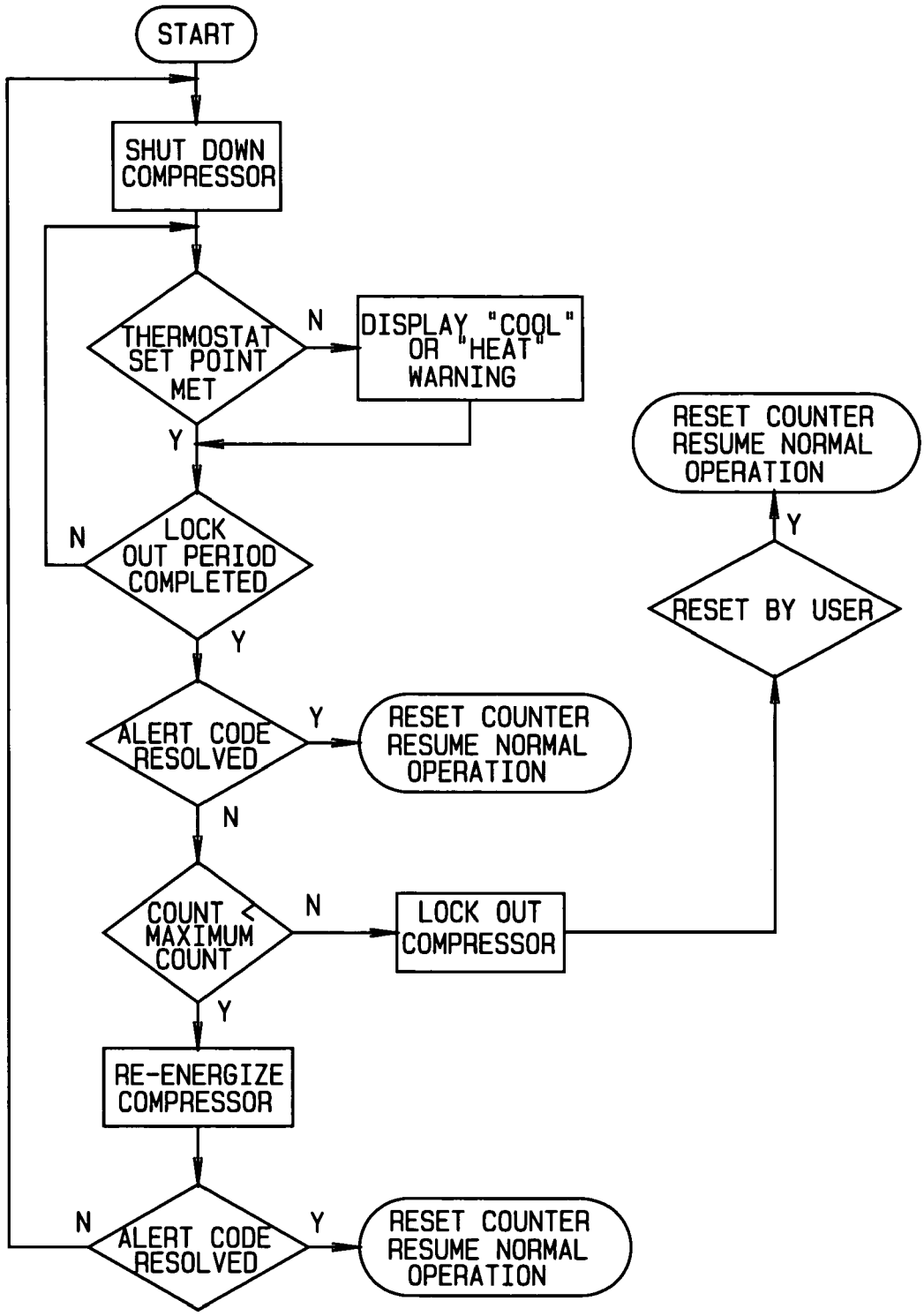
FIG. 7 is a flowchart of a first possible response by the thermostat to an alert signal from a compressor health indicator.

In addition to displaying information about the error code from the Comfort Alert™ module 28, the thermostat can take corrective action in response to the error code. The thermostat preferably waits until it receives at least two consecutive signals before taking action. As shown in FIG. 7, after the thermostat has received at least two consecutive flash code 2 signals (it takes 10±6 s to receive two consecutive signals) the thermostat de-energizes the compressor and locks it out for five minutes. While the compressor is locked out, the thermostat 100 displays a flashing "COOL" signal 44 if there is an unmet demand for cooling (in an air conditioning or heat pump system), and the thermostat displays a flashing "HEAT" signal 46 if there is an unmet demand for heating (in a heat pump system). These signals flash at a rate of 1 Hz (±10%), and serve to explain to the user the source of the problem when the user checks the thermostat because the space is warmer or cooler than desired.

After the five minute lockout, when the thermostat set point is not satisfied, the thermostat 100 will reenergize the compressor, even if the signal from the Comfort Alert™ module 28 is still present. If normal operation does not resume, the thermostat 100 again deenergizes the compressor, and locks the compressor out for five minutes, the thermostat again tries to reenergize the compressor the next time that the set point of the thermostat is not met, and this cycle continues with a counter being incremented each time, for a predetermined number (e.g., thirty) attempts. If the error code from the Comfort Alert™ module 28 is resolved during one of these thirty attempts, normal operation resumes and the counter is reset. If the error code from the Comfort Alert™ module 28 is not resolved after the thirty attempts, the thermostat permanently locks out the compressor. An indicator will flash on the thermostat in sync with the Comfort Alert™ module 28 signal, and whenever the set point of the thermostat is not met, a "COOL" signal 44 or "HEAT" signal 46, as applicable will flash at 60 Hz±10%. This will continue until the signal from the Comfort Alert™ module 28 ceases, or until the user changes the set point of the thermostat by pressing the temperature up button 40 or temperature down button 42, which resets the counter and causes the thermostat to restart attempts to reenergize the compressor.

In this preferred embodiment, the thermostat preferably responds to an alert code 3 signal from the Comfort Alert™ module 28 the same way that it response to an alert code 2 signal, described above and illustrated in FIG. 7.

Figure 8:
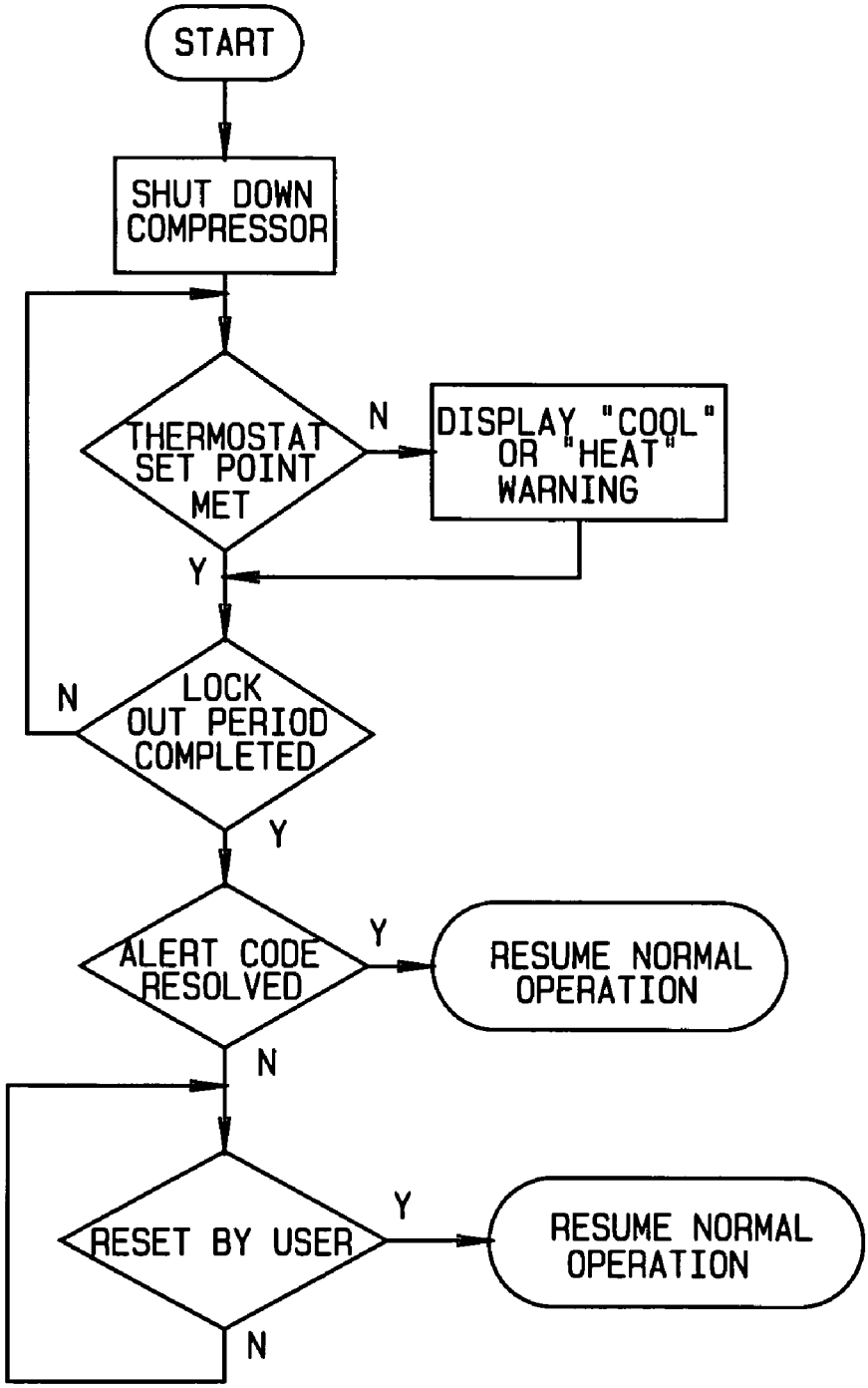
FIG. 8 is a flowchart of a second possible response by the thermostat to an alert signal from a compressor health indicator.

As shown in FIG. 8, after the thermostat has received at least two consecutive alert flash code 4 signals from the Comfort Alert™ module 28 (it takes 10±6 s to receive two consecutive signals) the thermostat 100 de-energizes the compressor and locks it out. The thermostat will not reenergize the compressor until the flash code 4 signal from the Comfort Alert™ module 28 discontinues, or until the user presses any button (e.g., the temperature up button 40 or the temperature down button 42) on the thermostat 100 to reset the thermostat. When the set point of the thermostat 100 is not met while the compressor is locked out, the thermostat displays a flashing "COOL" signal 44 if there is an unmet demand for cooling (in an air conditioning or heat pump system), and the thermostat displays a flashing "HEAT" signal 46 if there is an unmet demand for heating (in a heat pump system). These signals flash at a rate of 1 Hz (±10%), and serve to explain to the user the source of the problem when the user checks the thermostat because the space is warmer or cooler than desired.

If the thermostat is reset by the user's pressing a button on the thermostat, e.g., the temperature up button 40 or temperature down button 42, the thermostat 100 will energize the compressor for 30 ±10 after a minimum lockout time of five minutes. If the Comfort Alert™ module 28 error code is discontinued, the thermostat resumes normal operation, and the fault indicator is removed.

Figure 9:
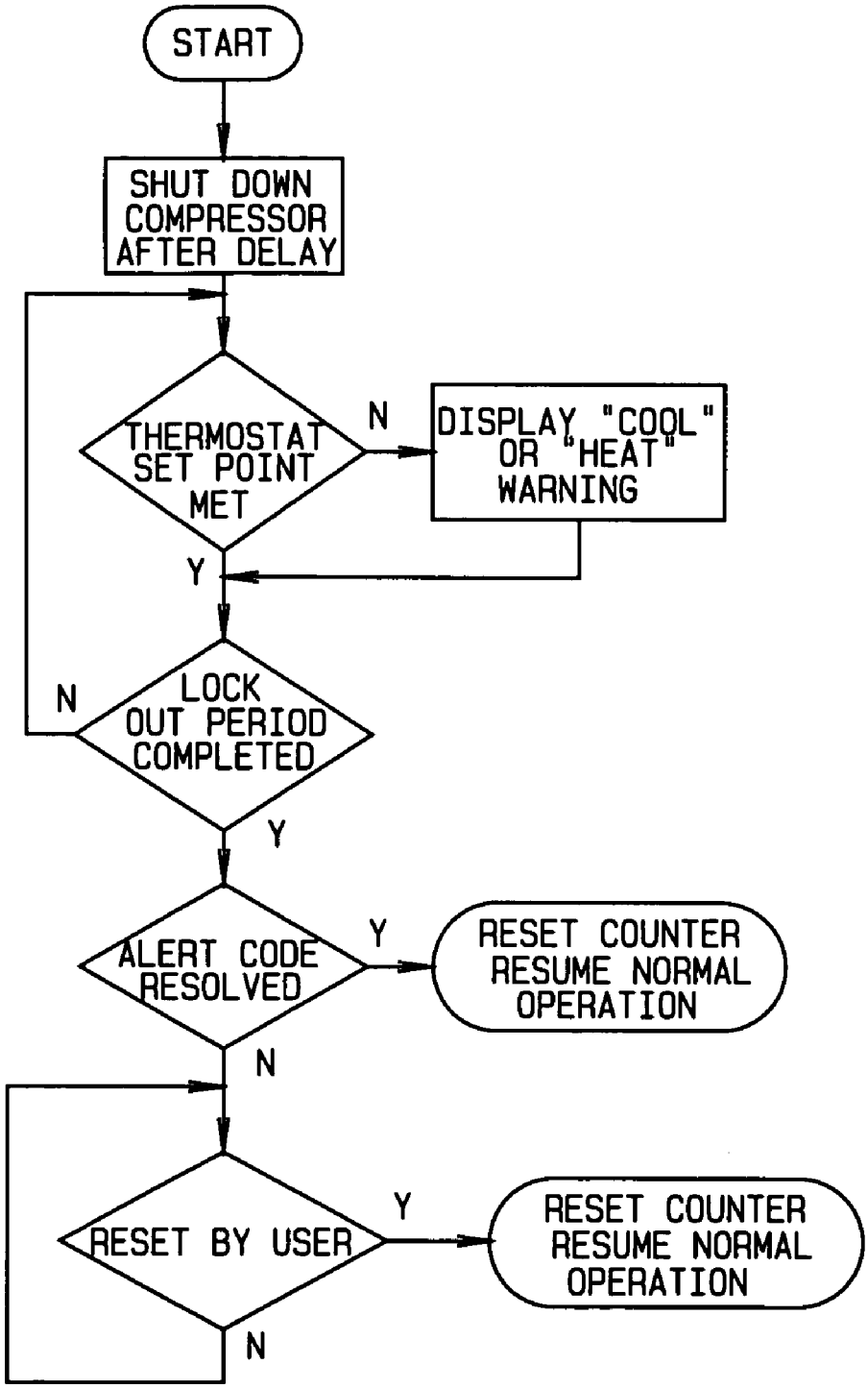
FIG. 9 is a flowchart of a third possible response by the thermostat to an alert signal from a compressor health indicator.

As shown in FIG. 9, after the thermostat has received at least two consecutive flash code 6 signals from the Comfort Alert™ module 28 (it takes 10±6 s to receive two consecutive signals) the thermostat de-energizes the compressor after 180±1 minutes. The thermostat 100 locks out the compressor until the flash code signal 6 from the Comfort Alert™ module 28 discontinues, or until the user presses any button on the thermostat to reset the thermostat. When the set point of the thermostat is not met while the compressor is locked out, the thermostat displays a flashing "COOL" signal 44 if there is an unmet demand for cooling (in an air conditioning or heat pump system), and the thermostat displays a flashing "HEAT" signal 46 if there is an unmet demand for heating (in a heat pump system). These signals flash at a rate of 1 Hz (±10%), and serve to explain to the user the source of the problem when the user checks the thermostat because the space is warmer or cooler than desired.

If the thermostat is reset by the user's pressing a button on the thermostat, e.g., the temperature up button 40 or temperature down button 42, the thermostat will energize the compressor for 30±10 after a minimum lockout time of five minutes. If the Comfort Alert™ module 28 error code is discontinued, the thermostat resumes normal operation, and the fault indicator is removed.

In this preferred embodiment, the thermostat preferably responds to an alert code 7 signal from the Comfort Alert™ module 28 the same way that it response to an alert code 6 signal, described above and illustrated in FIG. 9.

EXAMPLE 2

Figure 10:
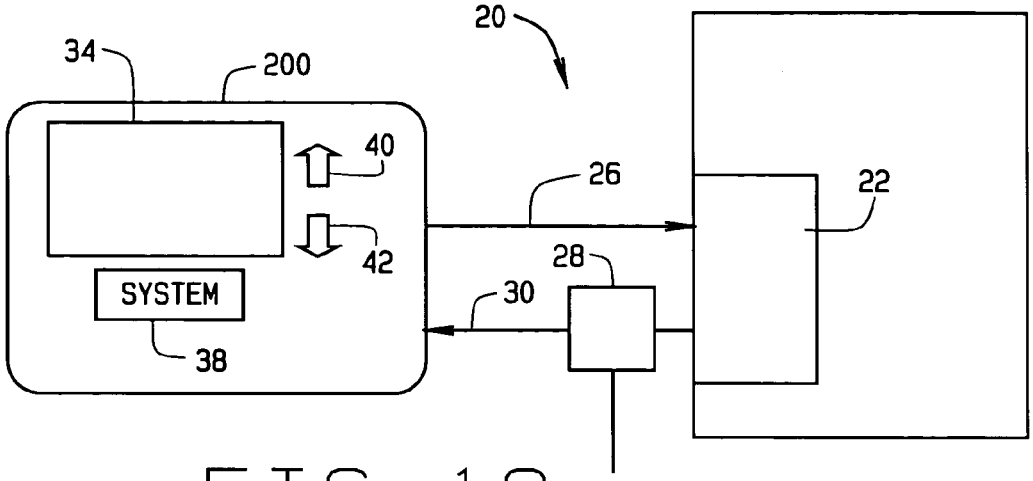
FIG. 10 is a schematic diagram of a second preferred embodiment of a thermostat, adapted for use with a commercially available compressor health indicator.

The thermostat 200 in FIG. 10 is adapted for operation with another compressor health module, such as the YorkGuard V module 28. The YorkGuard V module 28 generates pulsed alert signals, which like the signals from the Comfort Alert™ module, comprise a series of pulses of fixed lengths follows by a dwell of fixed length. These signals are identified in Table 2, below. However, in contrast to the Comfort Alert™ module, the YorkGuard V module 28 generates pulses of 0.25s and dwells of 0.25s. The thermostat 200 is adapted to be connected to the YorkGuard V module 28, counts the pulses to determine the signal being sent by the YorkGuard V module, and display the signals being generated by the YorkGuard V module 28. This allows a service technician to determine the status of the compressor from either the YorkGuard V module 28 directly, or from thermostat 100.

TABLE 2

| Status | Status description | EXAMPLE CODES FROM A YORKGUARD V MODULE<br>Troubleshooting Information | |
|---|---|---|---|
| 2 | High discharge pressure | System Pressure Trip<br>Discharge or suction pressure out of limits or compressor overloaded | 1. High head pressure<br>Check high pressure switch if present in system<br>Check if system is overcharged with refrigerant<br>Check for non-condensable in system<br>2. Condenser coil poor air circulation (dirty, blocked, damaged)<br>3. Condenser fan is not running<br>4. Return air duct has substantial leakage<br>5. If low pressure switch present in system, refer to Flash Code 1 |
| 3 | High discharge temperature | | |
| 4 | Low discharge temperature | Locked Rotor | |
| 5 | Defrost failure | | |
| 7 | Ambient sensor failure | | |
| 8 | Liquid line sensor failure | | |
| 9 | Bonnet sensor failure | | |

The thermostat 200 has a diode 202 that blinks in synchronization with the signals generated by the YorkGuard V module 28. The thermostat 200 also has a display 204 for displaying a message. This message may be a predetermined message for all signals from the YorkGuard V module 28, such as "FAULT". The message can blink in synchronization with the signals generated by the YorkGuard V module 28. Thus by watching either the blinking diode or the blinking message on the thermostat 200, a service technician can determine the status of the compressor as indicated by the YorkGuard V module 28. The thermostat 200 includes means, such as a microprocessor, for determining the blink rate, and thus identifying the particular signal being generated by the YorkGuard V module 28. In response, the thermostat can display an error code or text message specific to the signal generated by the YorkGuard V module 28. For example, the thermostat could display a numerical code or a text explanation of the error code.

The thermostat 200 responds to the various signals from the YorkGuard V similar to the response to the Comfort Alert™ module, temporarily and or permanently locking out the compressor, and/or selectively reenergizing the compressor as appropriate for the particular alert signal. More specifically, a status signal 2 from the YorkGuard V module 28, is triggered by a high discharge pressure. After the thermostat 200 has received at least two consecutive flash code 2 signals (to avoid error) the thermostat de-energizes the compressor and locks it out for five minutes. While the compressor is locked out, the thermostat 200 may display a flashing "COOL" signal (similar to signal 44 in the first preferred embodiment) if there is an unmet demand for cooling (in an air conditioning or heat pump system), and the thermostat may display a flashing "HEAT" signal (similar to signal 46 in the first preferred embodiment) if there is an unmet demand for heating (in a heat pump system). These signals preferably flash at a rate of 1 Hz (±10%), and serve to explain to the user the source of the problem when the user checks the thermostat because the space is warmer or cooler than desired.

After the five minute lockout, when the thermostat set point is not satisfied, the thermostat 200 will reenergize the compressor, even if the signal from the YorkGuard V module 28 is still present. If normal operation does not resume, the thermostat 100 again deenergizes the compressor, and locks the compressor out for five minutes, the thermostat again tries to reenergize the compressor the next time that the set point of the thermostat is not met, and this cycle continues with a counter being incremented each time, for a predetermined number (e.g., thirty) attempts. If the error code from the YorkGuard V module 28 is resolved during one of these thirty attempts, normal operation resumes and the counter is reset. If the error code from the YorkGuard module 28 is not resolved after the thirty attempts, the thermostat permanently locks out the compressor. An indicator will flash on the thermostat, preferably in sync with the YorkGuard V module 28 signal, and whenever the set point of the thermostat is not met, a "COOL" signal or "HEAT" signal, as applicable, will flash at 60 Hz±10%. This will continue until the signal from the YorkGuard V module 28 ceases, or until the user changes the set point of the thermostat by pressing the temperature up button 40 or temperature down button 42, which resets the counter and causes the thermostat to restart attempts to reenergize the compressor.

A status signal 4 from the YorkGuard V module 28, is triggered by a low discharge temperature, and indicates either a locked rotor or other problem with the compressor. After the thermostat 200 has received at least two consecutive alert flash code 4 signals (to avoid errors) from the YorkGuard V module 28 the thermostat 200 de-energizes the compressor and locks it out. The thermostat will not reenergize the compressor until the flash code 4 signal from the York Guard V module 28 discontinues, or until the user presses any button (e.g., the temperature up button 40 or the temperature down button 42) on the thermostat 200 to reset the thermostat. When the set point of the thermostat 200 is not met while the compressor is locked out, the thermostat may display a flashing "COOL" signal if there is an unmet demand for cooling (in an air conditioning or heat pump system), and the thermostat may display a flashing "HEAT"

signal if there is an unmet demand for heating (in a heat pump system). These signals preferably flash at a rate of 1 Hz (±10%), and serve to explain to the user the source of the problem when the user checks the thermostat because the space is warmer or cooler than desired.

If the thermostat is reset by the user's pressing a button on the thermostat, e.g., the temperature up button 40 or temperature down button 42, the thermostat 200 will energize the compressor for 30±10 after a minimum lockout time of five minutes. If the YorkGuard V module 28 error code is discontinued, the thermostat resumes normal operation, and the fault indicator is removed.

EXAMPLE 3

Figure 11:
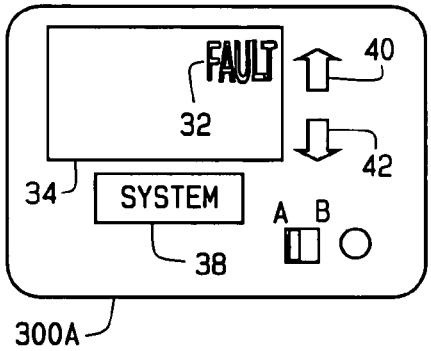
FIG. 11 is a schematic diagram of a first construction of a third preferred embodiment of a thermostat, that can be manually adapted for use with one of a plurality of commercially available compressor health indicators.
Figure 12:
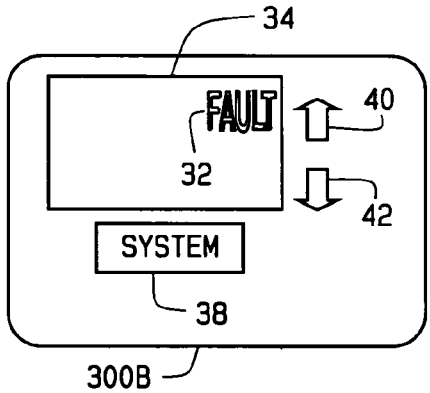
FIG. 12 is a schematic diagram of a second construction of a third preferred embodiment of a thermostat, that automatically adapts for use with one of a plurality of commercially available compressor health indicators.

Thermostats adapted for use with multiple compressor health indicators, including at least the Comfort Alert™ module and the YorkGuardV module are indicated as 300A in FIGS. 11 and 300B in FIG. 12. Although the method of sending numerical signals through the use of spaced pulses is similar, the same number codes between the two systems may have different meanings. Thus in addition to having a microprocessor or other means for counting the pulses to identify the signal, the thermostat preferably can differentiate signals from different types of compressor health modules. Thermostat 300A includes a switch 302 with at least two positions which allows the thermostat to be set up for receiving signals from either a Comfort Alert™ module or a YorkGuard V module. This allows the thermostat to take the appropriate action upon receipt of a signal. Thermostat 300B does not have a switch, but the thermostat is able to differentiate between at least the Comfort Alert™ module and the YorkGuard V modules based upon the differences in their signals. More specifically, the thermostat has a microprocessor or other sensing means for measuring either the lengths of the pulses, the lengths of the dwell after the pulses or both. The Comfort Alert™ has pulse lengths of 0.1s (100 msec) and dwells of 0.4s (400 msec), which can be distinguished from the YorkGuard V, which has pulse lengths of 0.25s (250 msec) and dwells of 0.25s (250 msec). Once the thermostat correctly identifies the compressor health indicator to which it is connected, the thermostat automatically adapts to respond to signals from the modules and operate the compressor.

Figure 13:
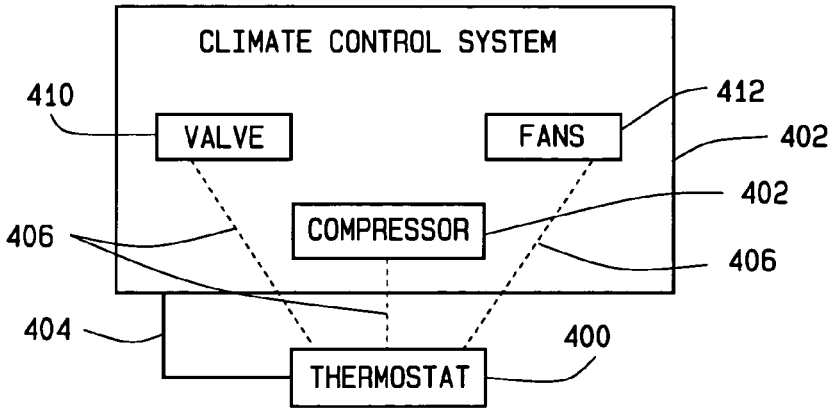
FIG. 13 is a schematic diagram of a fourth preferred embodiment of a thermostat shown as it would be incorporated into a climate control system.

As shown in FIG. 13 a thermostat 400 controlling a climate control system 402 via a link 404 can be adapted to receive signals directly from various components of the climate control system. While these signals can be communicated by wire, in retrofit applications this could require additional wires to be run between the components and the thermostat, and even in new installations could require that additional wires be installed. Thus, it is preferable that components communicate with the thermostat 400 wirelessly, for example by RF signal. The components may include a compressor 408, one or more valves 410, and one or more fans 412. In the case of the compressor 408, the information transmitted comprises information about compressor inlet temperature or pressure, or compressor outlet temperature or pressure could be provided direction to the thermostat 400. In the case of valves 410, the information could include the state of the valve (open or closed), the inlet pressure, and/or the outlet pressure. In the case of fans 412, the information could include the state of the fan (on or off), and/or the run time. Thermostat 300 can include a processor programmed to control the climate control system in response to such signals similar to the way the thermostats 24, 100 and 200 is programmed to responds to compressor health modules. The thermostat can include memory for storing the information provided to it by the various components, so that in addition to current magnitude of the operating parameter, the thermostat can take into account historical levels of the operating parameter, the direction of change of the operating parameter and/or the rate of change of the operating parameter.

There are other various changes and modifications which may be made to the particular embodiments of the invention described herein, as recognized by those skilled in the art. However, such changes and modifications to the invention may be implemented without departing from the scope of the invention. Thus, the invention should be limited only by the scope of the claims appended hereto, and their equivalents

What is claimed is:

1. A climate control system comprising a compressor, and module for generating at least one signal based upon the operation of the compressor, and a thermostat for controlling the compressor, the thermostat controlling the compressor in response to signals generated by the module;

wherein the thermostat locks out the compressor to prevent operation of the compressor for at least a predetermined lockout period in response to a signal generated by the module, and restarts the compressor at least once for a predetermined time after the predetermined lock out period if de-energizing the compressor does not clear the signal from the module.

2. A method of operating a climate control system including a compressor and a thermostat, the method comprising generating a signal based upon the operation of the compressor, and the thermostat controlling the compressor in response to the generated signal; wherein the thermostat restarts the compressor at least once for a predetermined time after a predetermined lock out period if deenergizing the compressor does not clear the generated signal.

3. A climate control system comprising: a compressor, and a module for generating at least one signal based upon the operation of the compressor, and a thermostat for controlling the compressor, the thermostat controlling the compressor in response to signals generated by the module;

wherein the thermostat is selectably operable between a lockout mode, in which thermostat locks out the compressor for at least temporarily in response to a signal from the module, and a non-lockout mode in which the thermostat displays an alarm but does not lock out the compressor in response to a signal from the module.

* * * * *